US010335640B2

(12) United States Patent
Hixenbaugh

(10) Patent No.: US 10,335,640 B2
(45) Date of Patent: Jul. 2, 2019

(54) GOLF BALL DIMPLE SURFACE

(71) Applicant: Acushnet Company, Fairhaven, MA (US)

(72) Inventor: Chris Hixenbaugh, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 433 days.

(21) Appl. No.: 14/586,478

(22) Filed: Dec. 30, 2014

(65) Prior Publication Data

US 2016/0184643 A1 Jun. 30, 2016

(51) Int. Cl.

| | |
|---|---|
| ***A63B 37/14*** | (2006.01) |
| ***A63B 37/12*** | (2006.01) |
| ***A63B 37/00*** | (2006.01) |
| *A63B 45/00* | (2006.01) |

(52) U.S. Cl.

CPC ..... *A63B 37/0004* (2013.01); *A63B 37/002* (2013.01); *A63B 45/00* (2013.01)

(58) Field of Classification Search

USPC ..... 473/383–384

See application file for complete search history.

(56) References Cited

U.S. PATENT DOCUMENTS 1,286,834 A * 12/1918 Taylor ..... A63B 37/0004 473/384
1,666,699 A * 4/1928 Hagen ..... A63B 37/0004 473/383
1,716,435 A * 6/1929 Fotheringham .... A63B 37/0004 473/383
4,681,323 A * 7/1987 Alaki ..... A63B 37/0004 273/DIG. 22
4,936,587 A * 6/1990 Lynch ..... A63B 37/0004 473/384
4,979,747 A * 12/1990 Jonkouski ..... A63B 37/0004 473/377
5,005,838 A * 4/1991 Oka ..... A63B 37/0004 40/327
5,536,013 A * 7/1996 Pocklington ..... A63B 37/0004 473/384
5,916,044 A * 6/1999 Shimosaka ..... A63B 37/0004 473/377
6,139,448 A * 10/2000 Sullivan ..... A63B 37/0004 473/377
6,315,686 B1 * 11/2001 Barfield ..... A63B 37/0004 473/378
6,626,772 B1 * 9/2003 Kennedy, III ..... A63B 37/0004 473/384
6,872,154 B2 * 3/2005 Shannon ..... A63B 37/0004 473/384
7,250,012 B1 * 7/2007 Simonds ..... A63B 37/0004 473/383
7,503,857 B2 * 3/2009 Kasashima ..... A63B 37/0004 473/383
7,867,109 B2 * 1/2011 Sullivan ..... A63B 37/0004 473/383

(Continued)

*Primary Examiner* — Eugene L Kim
*Assistant Examiner* — Matthew B Stanczak
(74) *Attorney, Agent, or Firm* — Mandi B. Milbank

(57) ABSTRACT

Golf ball dimples having a surface defined by a mode, or a weighted superposition of multiple modes, of oscillation of a circular membrane are disclosed.

6 Claims, 6 Drawing Sheets

(56) References Cited

U.S. PATENT DOCUMENTS

| | | | | |
|---|---|---|---|---|
| 8,591,355 | B2 * | 11/2013 | Sullivan | A63B 37/0004 473/383 |
| 8,834,302 | B2 * | 9/2014 | Nakamura | A63B 37/0004 473/383 |
| 8,956,252 | B2 * | 2/2015 | Nakamura | A63B 37/0018 473/371 |
| 2008/0045360 | A1 * | 2/2008 | Ohama | A63B 37/0003 473/384 |
| 2011/0195802 | A1 * | 8/2011 | Nakamura | A63B 37/0004 473/384 |
| 2012/0165130 | A1 * | 6/2012 | Madson | A63B 37/0015 473/384 |

* cited by examiner

GOLF BALL DIMPLE SURFACE

FIELD OF THE INVENTION

The present invention relates to a golf ball dimple having a shape defined by a mode, or a weighted superposition of multiple modes, of oscillation of a circular membrane.

BACKGROUND OF THE INVENTION

Golf ball dimples are known to have a significant effect on the aerodynamic forces acting on the ball during flight. For example, the dimples on a golf ball create a turbulent boundary layer around the ball. The turbulence energizes the boundary layer and helps it stay attached further around the ball to reduce the area of the wake. This greatly increases the pressure behind the ball and substantially reduces the drag. Based on the significant role that dimples play in golf ball design, manufacturers continually seek to develop novel dimple patterns, sizes, shapes, volumes, cross-sections, etc. Thus, the present invention provides a novel dimple design having unique aesthetic and aerodynamic characteristics.

SUMMARY OF THE INVENTION

In one embodiment, the present invention is directed to a golf ball having a plurality of recessed dimples on the surface thereof, wherein at least a portion of the recessed dimples have a surface defined by a mode, or a weighted superposition of multiple modes, of oscillation of a circular membrane which extends over a domain defined by the dimple diameter. The dimple surface is further defined by a Bessel function, as further described below, and includes single Bessel functions and combinations of two or more Bessel functions. In a particular embodiment, the dimple surface is defined by a spherical Bessel function, a modified Bessel function or a Riccati-Bessel function. In another particular embodiment, the dimple surface shape may contain a Bessel function of the third kind, known as a Hankel function, and, in a particular aspect of this embodiment, may contain a spherical Hankel function.

BRIEF DESCRIPTION OF DRAWINGS

In the accompanying drawings, which form a part of the specification and are to be read in conjunction therewith, and which are given by way of illustration only, and thus are not meant to limit the present invention.

DETAILED DESCRIPTION

Figure 1:
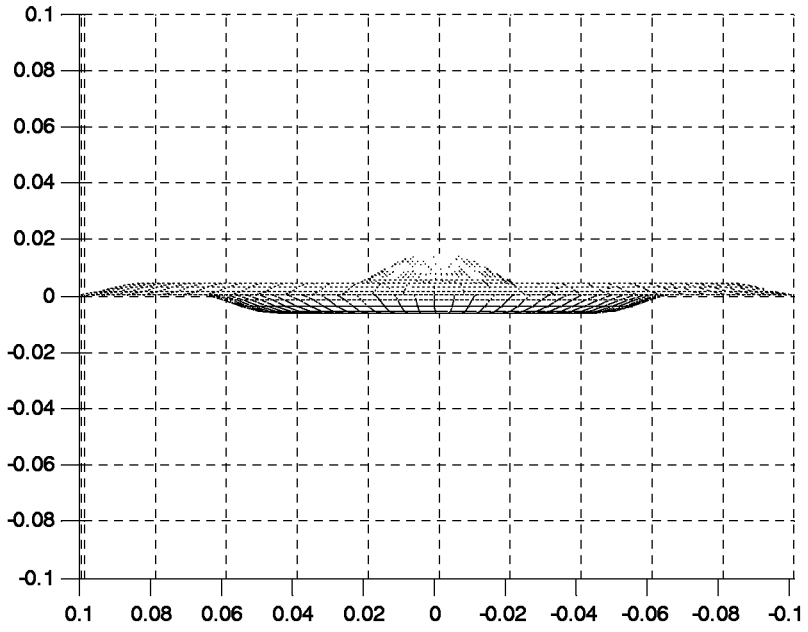
FIG. 1 shows a dimple cross-sectional profile according to an embodiment of the present invention.

Conventional golf ball dimples have a cross-sectional profile defined by a 2-dimensional curve that is rotated about a vertical axis to create the dimple surface. The present invention discloses a new method for designing a golf ball dimple by modeling the dimple as a mode, or a weighted superposition of multiple modes, of oscillation of a circular membrane.

Considering a circular membrane, the membrane extends over a domain, D, defined by $0<r<d_d$, where $d_d$ is the dimple diameter. The boundary of the dimple is given by $r=d_d$. The dimple diameter, $d_d$ is preferably from 0.005 inches to 0.300 inches, or $d_d$ is 0.005 inches or 0.020 inches or 0.100 inches or 0.220 inches or 0.250 inches or 0.300 or 0.350 inches, or $d_d$ is within a range having a lower limit and an upper limit selected from these values.

Using polar coordinate r and θ, the differential equation to describe the membrane's motion is:

$$\nabla^2 W(r,\theta)+\beta^2(r,\theta)=0, \quad \text{[Equation 1]}$$

where $$\beta^2=\frac{\rho\omega^2}{T}$$

and $$r,\theta \text{ in } D,$$

and $$\nabla^2=\frac{\partial^2}{\partial r^2}+\frac{1}{r}\frac{\partial}{\partial r}+\frac{1}{r^2}\frac{\partial^2}{\partial\theta^2}$$

To solve Equation 1, assume the solution of the form $W(r,\theta)=R(r)\Theta(\theta)$. Equation 1 is thus expressed as:

$$\left(\frac{\partial^2 R}{\partial r^2}+\frac{1}{r}\frac{\partial R}{\partial r}\right)\Theta+\frac{R}{r^2}\frac{\partial^2\Theta}{\partial\theta^2}+\beta^2 R\Theta=0 \quad \text{[Equation 2]}$$

Equation 2 has two solutions:

$$\frac{\partial^2\Theta}{\partial\theta^2}+m^2\Theta=0 \quad \text{[Equation 3]}$$

and $$\left(\frac{\partial^2 R}{\partial r^2}+\frac{1}{r}\frac{\partial R}{\partial r}\right)\Theta+\left(\beta^2\frac{m^2}{r^2}\right)R=0 \quad \text{[Equation 4]}$$

The constant $m^2$ is assumed to be positive to ensure a harmonic solution for θ. Also, since the solution must be continuous at $\theta=\theta_0$.

The solution of Equation 3 is:

$$\Theta_m=C_{1m}\sin(m\theta)+C_{2m}\cos(m\theta),\ m=0,1,2,\ldots \quad \text{[Equation 5]}$$

and the solution of Equation 4 is a Bessel solution of:

$$R_m(r)=C_{3m}J_m(\beta r)+C_{4m}Y_m(\beta r),\ m=0,1,2,\ldots \quad \text{[Equation 6]}$$

where $J_m(\beta r)$ and $Y_m(\beta r)$ are Bessel functions of the $m^{th}$ order and are Bessel functions of the first and second kind, respectively.

The general solution can be expressed as:

$$W(r,\theta)=A_{1m}J_m\sin(\beta\theta)+A_{2m}J_m\cos(\beta\theta)+A_{3m}Y_m\sin(\beta\theta)+A_{4m}Y_m\cos(\beta\theta),\ m=0,1,2,\ldots \quad \text{[Equation 7]}$$

For dimple design, a membrane fixed at the boundary $r=d_d$ is desired. The boundary condition at $r=d_d$ is $W_m(d_d,\theta)=0$, m=0, 1, 2, . . . .

The displacement must be finite for every point not at the boundary. However, Bessel functions of the second kind approach infinity as input parameter approaches zero, i.e., $A_{3m}=A_{4m}=0$. Thus, Equation 7 becomes $$W(r,\theta)=A_{1m}J_m \sin(\beta\theta)+A_{2m}J_m \cos(\beta\theta),\ m=0,1,2,\ldots \quad \text{[Equation 8]}$$

and, at $r=d_d$, $$W(d_d,\theta)=A_{1m}J_m(\beta\alpha)\mathrm{Sin}(\beta\theta)+A_{2m}J_m(\beta\alpha)\mathrm{Cos}(\beta\theta),\ m=0,1,2\ldots \quad \text{[Equation 9]}$$

Regardless of the value of θ, the condition described in Equation 9 can only be satisfied if $J_m(\beta\alpha)=0$, m=0, 1, 2, . . . , which suggest an infinite number of frequency equations. For every m, there is an infinite number of discrete solutions $\beta_{mn}$ corresponding to the zeros of the Bessel function $J_m$. For each frequency $\omega_{mn}$, there are two normal modes of oscillation, except when m=0. In the case of m=0, there is only one normal mode of oscillation. The normal modes are degenerate when m≠0.

The modes of oscillation can, thus, be written as $$W_{0n}(r,\theta)=A_{0n}J_0(\beta_{0n}r),\ m=0,\ n=0,1,2\ldots \quad \text{[Equation 10]}$$

$$W_{mnc}(r,\theta)=A_{mnc}J_m(\beta_{mn}r)\cos(m\theta),\ m=1,2,\ldots\ n=0,1,2\ldots \quad \text{[Equation 11]}$$

$$W_{mns}(r,\theta)=A_{mns}J_m(\beta_{mn}r)\sin(m\theta),\ m=1,2,\ldots\ n=0,1,2\ldots \quad \text{[Equation 12]}$$

which can be manipulated for dimple design to be:

$$W_{0n}(r,\theta)=C_dJ_m(\beta_{mn}r),\ m=0,\ n=1,2\ldots \quad \text{[Equation 13]}$$

$$W_{mnc}(r,\theta)=C_dJ_m(\beta_{mn}r)\cos(m\theta),\ m,n=1,2\ldots \quad \text{[Equation 14]}$$

$$W_{mns}(r,\theta)=C_dJ_m(\beta_{mn}r)\sin(m\theta),\ m,n=1,2\ldots \quad \text{[Equation 15]}$$

where $C_d$ is the chord depth (in inches).

Figure 2:
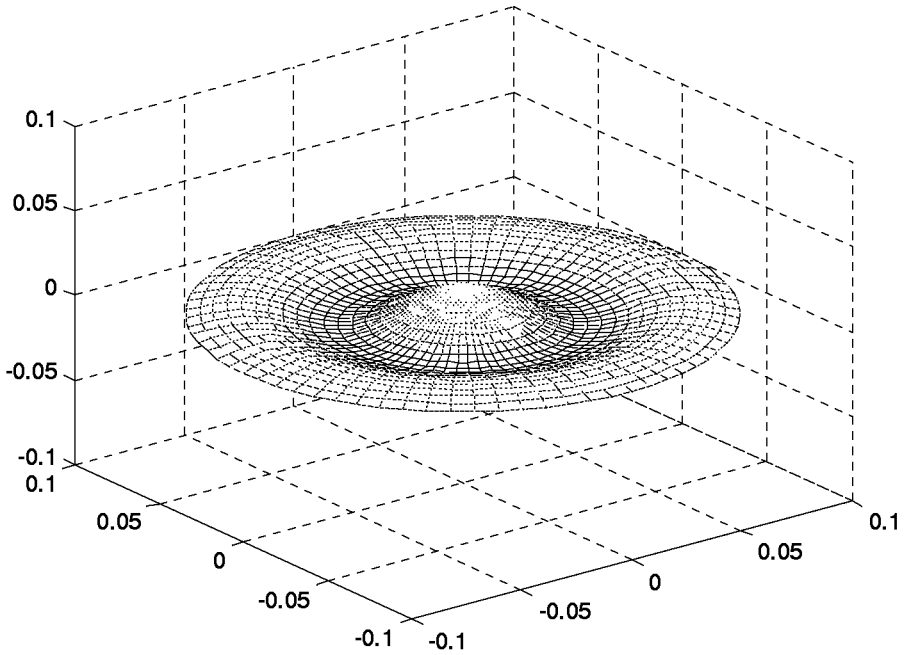
FIG. 2 is a perspective view of the dimple in FIG. 1.

FIGS. 1 and 2 show a dimple cross-sectional profile and a perspective view, respectively, of a dimple according to an embodiment of the present invention wherein m is 0, n is 3, and $C_d$ is 0.015 inches.

Figure 3:
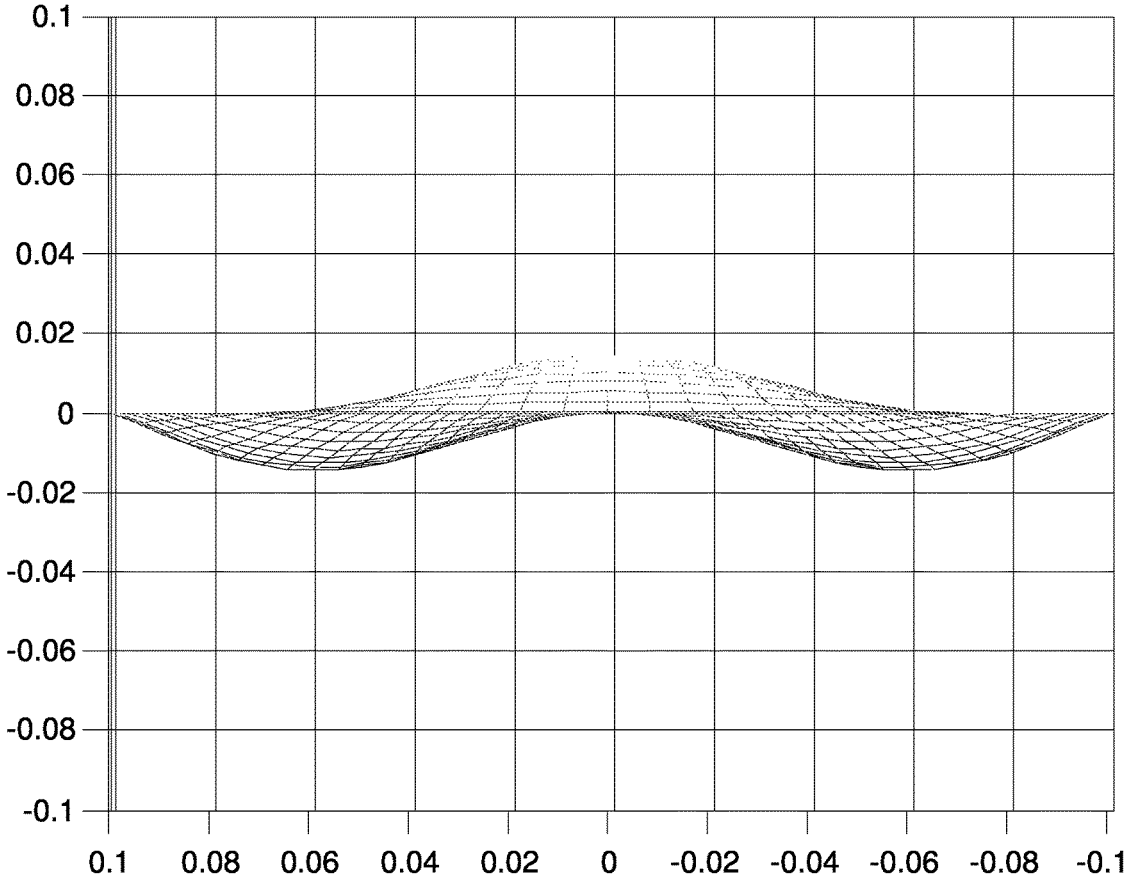
FIG. 3 shows a dimple cross-sectional profile according to an embodiment of the present invention.
Figure 4:
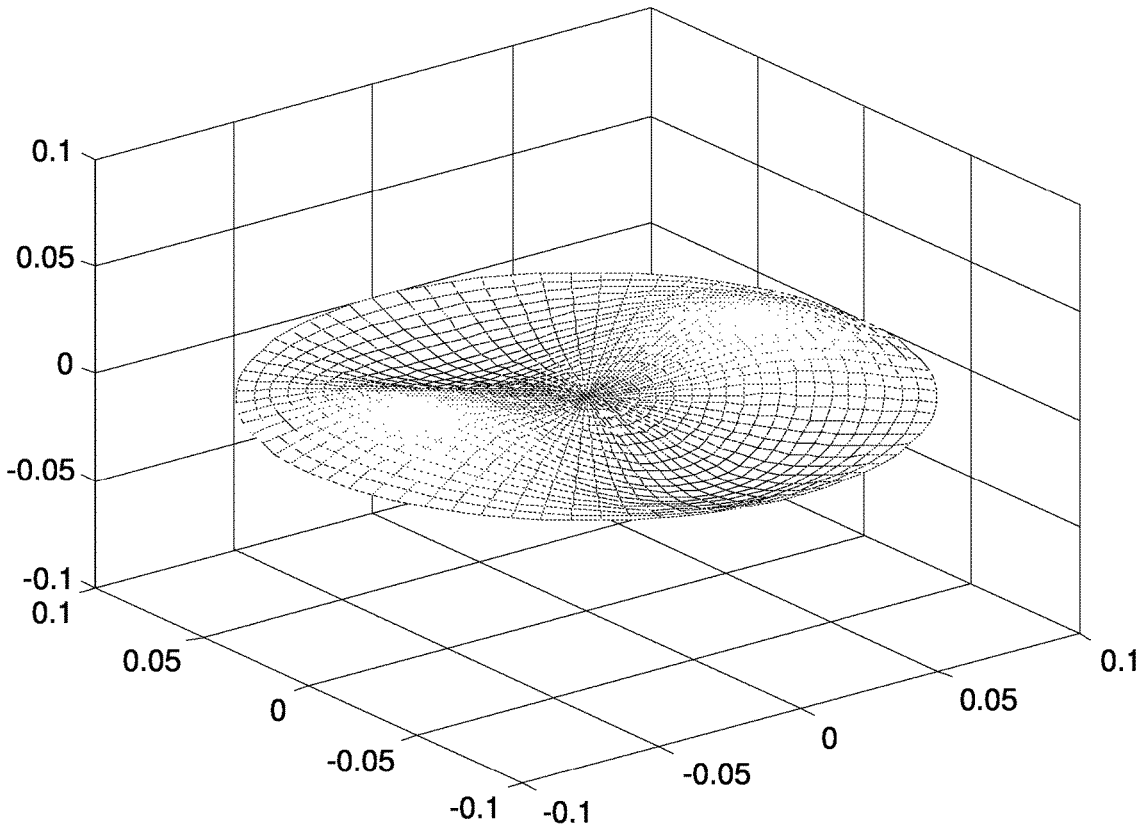
FIG. 4 is a perspective view of the dimple in FIG. 3.

FIGS. 3 and 4 show a dimple cross-sectional profile and a perspective view, respectively, of a dimple according to an embodiment of the present invention wherein m is 2, n is 1, and $C_d$ is 0.015 inches.

Figure 5:
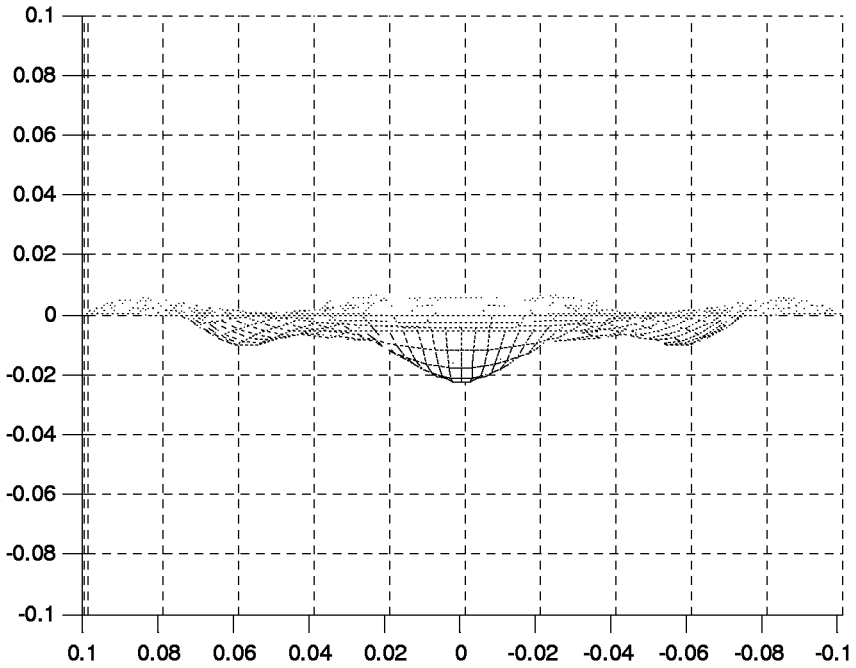
FIG. 5 shows a dimple cross-sectional profile according to an embodiment of the present invention.
Figure 6:
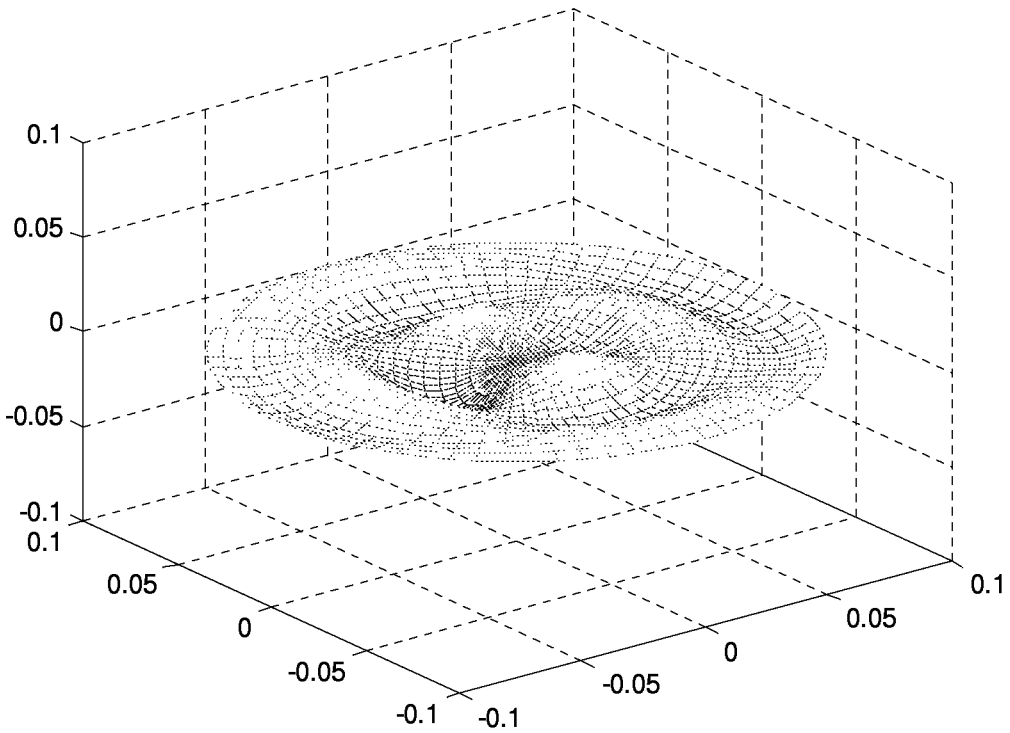
FIG. 6 is a perspective view of the dimple in FIG. 5.
Figure 7:
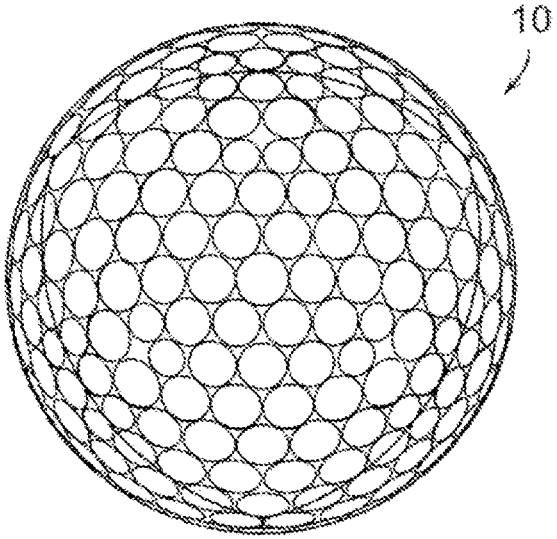
FIG. 7 illustrates a golf ball 10 according to an embodiment of the present invention.

In a particular embodiment, the present invention is directed to dimples having a surface defined by the superposition of a combination of two or more of the modes of oscillation described in Equations 13, 14 and 15. Thus, FIGS. 5 and 6 show a dimple cross-sectional profile and a perspective view, respectively, of a dimple according to an embodiment of the present invention created from the superposing of the modes of oscillation shown in FIGS. 1 and 3. Dimples defined by the weighted superposition of two or more shapes are further disclosed, for example, in U.S. Patent Application Publication No. 2013/0172125, the entire disclosure of which is hereby incorporated herein by reference.

For purposes of the present invention, chord depth is defined as the maximum height or depth of the dimple with respect to the hob surface, whichever value is greater. Chord depth must be defined in this fashion due to the multitude of inflection points a given dimple designed using this method may have. The chord depth of dimples having a shape defined according to the present invention is typically 0.001 inches or 0.005 inches or 0.007 inches or 0.010 inches or 0.015 inches or 0.030 inches, or is within a range having a lower limit and an upper limit selected from these values.

The edge angle of dimples having a shape defined according to the present invention is typically 1° or 5° or 90° or 100°, or is within a range having a lower limit and an upper limit selected from these values.

The volume ratio, $V_0$, for dimples having a shape defined according to the present invention is the fractional ratio of the dimple volume, V, divided by the volume of a cylinder defined by a similar diameter and chord depth of the dimple. The volume ratio is typically 0.001 or 0.05 or 0.96 or 1.0 or is within a range having a lower limit and an upper limit selected from these values.

Dimples having a shape defined according to the present invention may be described as concave up or concave down.

Dimples having a shape defined according to the present invention may have any number of inflection points.

The present invention is not limited by any particular dimple pattern. Examples of suitable dimple patterns include, but are not limited to, phyllotaxis-based patterns; polyhedron-based patterns; and patterns based on multiple copies of one or more irregular domain(s) as disclosed in U.S. Pat. No. 8,029,388, the entire disclosure of which is hereby incorporated herein by reference; and particularly dimple patterns suitable for packing dimples on seamless golf balls. Non-limiting examples of suitable dimple patterns are further disclosed in U.S. Pat. Nos. 7,927,234, 7,887,439, 7,503,856, 7,258,632, 7,179,178, 6,969,327, 6,702,696, 6,699,143, 6,533,684, 6,338,684, 5,842,937, 5,562,552, 5,575,477, 5,957,787, 5,249,804, 5,060,953, 4,960,283, and 4,925,193, and U.S. Patent Application Publication Nos. 2006/0025245, 2011/0021292, 2011/0165968, and 2011/0183778, the entire disclosures of which are hereby incorporated herein by reference. Non-limiting examples of seamless golf balls and methods of producing such are further disclosed, for example, in U.S. Pat. Nos. 6,849,007 and 7,422,529, the entire disclosures of which are hereby incorporated herein by reference.

In a particular embodiment, the dimple pattern provides for overall dimple coverage of 60% or greater, or 65% or greater, or 75% or greater, or 80% or greater, or 85% or greater, or 90% or greater.

Golf balls of the present invention typically have a dimple count within a limit having a lower limit of 250 and an upper limit of 350 or 400 or 450 or 500. In a particular embodiment, the dimple count is 252 or 272 or 302 or 312 or 320 or 328 or 332 or 336 or 340 or 352 or 360 or 362 or 364 or 372 or 376 or 384 or 390 or 392 or 432.

Preferably, at least 30%, or at least 50%, or at least 60%, or at least 80%, or at least 90%, or at least 95% of the total number of dimples have a shape defined by a mode, or a weighted superposition of multiple modes, of oscillation of a circular membrane, with the remaining dimples, if any, having a plan shape and a cross-sectional profile based on any known dimple plan and profile shape Among the dimples having a shape defined according to the present invention, the shape of one dimple may be the same as or different from the shape of another dimple. Similarly, among the remaining dimples, if any, having a known dimple plan shape and profile shape, the plan shape and/or profile shape of one dimple may be the same as or different from the plan shape and/or profile shape of another dimple.

The present invention is not limited by any particular golf ball construction or any particular composition for forming the golf ball layers. For example, dimples having a shape according to the present invention can be used to form dimples on one-piece, two-piece (i.e., a core and a cover), multi-layer (i.e., a core of one or more layers and a cover of one or more layers), and wound golf balls, having a variety of core structures, intermediate layers, covers, and coatings.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of recessed dimples on the surface thereof, wherein at least one of the dimples has a chord depth of from 0.001 inches to 0.030 inches and a dimple surface defined by a Bessel function with a membrane fixed at the boundary, wherein the Bessel function is of the $m^{th}$ order wherein m=2 and n=1.

2. The golf ball of claim 1, wherein each of the dimples having a surface defined by a Bessel function of the $m^{th}$ order has a diameter of from 0.005 inches to 0.300 inches.

3. The golf ball of claim 1, wherein the dimples having a surface defined by a Bessel function of the $m^{th}$ order have a chord depth of from 0.005 inches to 0.015 inches.

4. The golf ball of claim 1, wherein the dimples having a surface defined by a Bessel function of the $m^{th}$ order have a chord depth of from of from 0.007 inches to 0.010 inches.

5. The golf ball of claim 1, wherein the dimples having a surface defined by a Bessel function of the $m^{th}$ order have an edge angle of from 1° to 100°.

6. The golf ball of claim 1, wherein the dimples having a surface defined by a Bessel function of the $m^{th}$ order have an edge angle of from 5° to 90°.

* * * * *